US008530391B2

(12) United States Patent
Bohn

(10) Patent No.: US 8,530,391 B2
(45) Date of Patent: Sep. 10, 2013

(54) METHOD AND DEVICE FOR COLD GAS SPRAYING

(75) Inventor: Matthias Bohn, Petershagen (DE)

(73) Assignee: Linde Aktiengesellschaft, Munich (DE)

( * ) Notice: Subject to any disclaimer, the term of this patent is extended or adjusted under 35 U.S.C. 154(b) by 925 days.

(21) Appl. No.: 12/432,406

(22) Filed: Apr. 29, 2009

(65) Prior Publication Data

US 2009/0291851 A1 Nov. 26, 2009

(30) Foreign Application Priority Data

May 21, 2008 (DE) ..... 10 2008 024 504

(51) Int. Cl.
*H01L 39/24* (2006.01)
*B05D 1/12* (2006.01)
*B05D 1/36* (2006.01)

(52) U.S. Cl.
USPC ..... 505/470; 505/434; 505/739; 505/818; 427/62; 427/191; 427/201; 427/205; 427/427

(58) Field of Classification Search
USPC ..... 505/100, 150, 434, 470, 473, 477, 505/704; 427/62, 126.1, 180, 201, 203, 427, 427/427.3, 446, 189.1, 191, 205
See application file for complete search history.

(56) References Cited

U.S. PATENT DOCUMENTS 5,635,730 A * 6/1997 Sakakibara ..... 257/34
5,646,094 A 7/1997 Tallon et al.
8,012,601 B2 * 9/2011 Kruger et al. ..... 428/688
2002/0056473 A1 5/2002 Chandra et al.
2004/0003768 A1 * 1/2004 Goyal ..... 117/2
2004/0026030 A1 * 2/2004 Hatono et al. ..... 156/279
2008/0216602 A1 * 9/2008 Zimmermann et al. ..... 75/245
2008/0271779 A1 * 11/2008 Miller et al. ..... 136/252
2009/0239754 A1 * 9/2009 Kruger et al. ..... 505/473

FOREIGN PATENT DOCUMENTS

DE 38 06 177 A1 9/1998
EP 1 382 720 5/2003
WO WO 2004/044672 A2 5/2004
WO WO 2006/061384 * 6/2006
WO WO 2006/061384 A1 6/2006

OTHER PUBLICATIONS

Lima, Karthikeyan, Kay Lindemann and Berndt, "Microstructural characteristics of cold-sprayed nanostructured WC-Co coatings", Thin Solid Films 416 (2002) pp. 129-135, Elsevier.

* cited by examiner

*Primary Examiner* — Stanley Silverman
*Assistant Examiner* — Kallambella Vijayakumar
(74) *Attorney, Agent, or Firm* — Philip H. Von Neida

(57) ABSTRACT

A device for coating at least one substrate or for producing at least one molding by means of at least one cold gas spraying pistol, wherein the cold gas spraying pistol and the substrate or molding to be coated are arranged in a vacuum chamber, and also a method for cold gas spraying relating thereto in such a manner that while eliminating the wire production, the coil winding and also the cast in procedure, a thoroughly compact coil without a degree of freedom of movement (elimination of the quench risk) can be produced, it is suggested that the particles have at least to some extent an electrically conducting, in particular superconducting, property and at least to some extent an electrically poorly conducting or electrically insulating property.

7 Claims, 1 Drawing Sheet

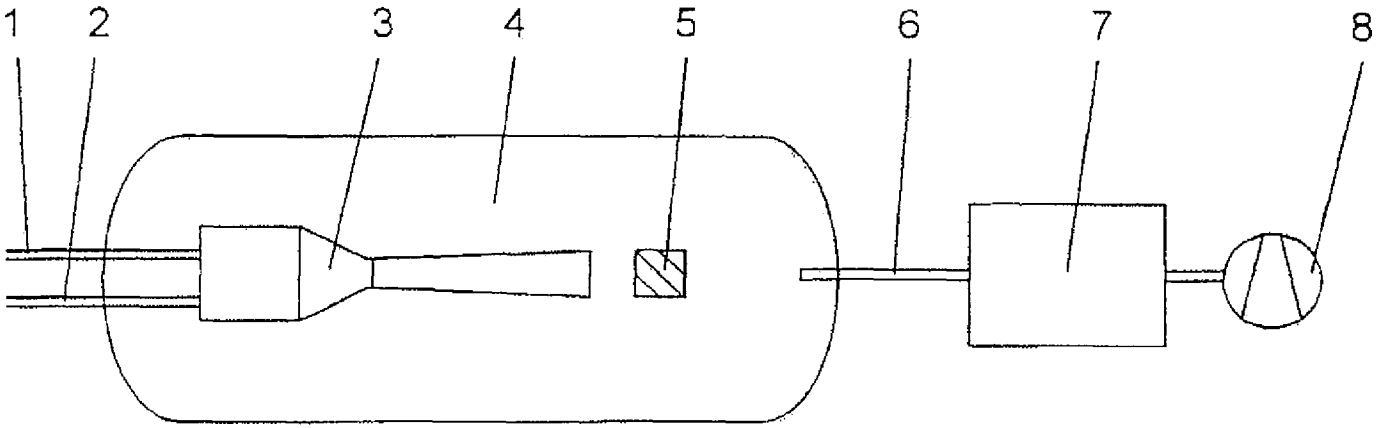
1
2
3
4
5
6
7
8

METHOD AND DEVICE FOR COLD GAS SPRAYING

BACKGROUND OF THE INVENTION

The present invention relates to a method for cold gas spraying, in which, to coat at least one substrate or to produce at least one molding, particles are accelerated to the surface of the substrate or molding in the unmelted state by means of at least one gas jet and adhere there under the conversion of their kinetic energy (cf. published document EP 1 382 720 A2 from the prior art).

The present invention furthermore relates to a device for coating at least one substrate or for producing at least one molding by means of at least one cold gas spraying pistol, wherein the cold gas spraying pistol and the substrate or molding to be coated are arranged in a vacuum chamber (cf. EP 1 382 720 A2 from the prior art).

Conductors and coils, particularly superconducting coils, are conventionally principally produced as wires, often in the form of a copper matrix with filaments of the superconductor. Mention may be made here, for example, of niobium-titanium (NbTi) or also of niobium-tantalum as an important superconducting material. Especially in the case of brittle materials, particularly in the case of high-temperature superconductor materials (what are known as HTSC materials), production takes place in complex sintering processes.

The wires produced in this manner are subsequently wound to form coils, for the most part on coil formers that are used for the stabilization of the coil. Additionally, the wires can also be cast in, for the most part in synthetic resins. This casting in synthetic resins serves to stabilize the coils completely, so that the coils can withstand the large forces acting in the superconductively-generated magnetic field. Large forces of this type act in particular in devices for nuclear magnetic resonance (NMR) imaging and in devices for nuclear magnetic resonance (NMR) spectroscopy.

If individual coil portions are not sufficiently fixed, then the micro-movements occurring lead to the breakdown of the superconduction (what is known as quench, in which the superconductor changes suddenly from the superconducting state to the normal-conducting state, whereby a great deal of heat is generated; quench is particularly dangerous in the case of superconducting coils, as the entire field energy is converted to heat there when the superconduction breaks down).

In the published document DE 38 06 177 A1 from the prior art, the use of ceramic powder with superconducting properties as a starting material for the application of high-temperature superconductor material to workpieces by means of thermal spraying is disclosed. The superconducting properties are regenerated by means of a targeted heat treatment following the spraying on.

According to this published document DE 38 06 177 A1, the current carrying capacity of the high-temperature superconductor layers is improved in that the thermal spraying takes place under conditions in which the particles in the spray jet have a low characteristic temperature and a high airspeed, as a result of which, when impinging onto the substrate, a high degree of deformation is effected. The subsequent heat treatment takes place in such a manner that a growth in the grains of the crystallites in the layer is achieved as a function of the degree of deformation.

In the published document WO 2006/061384 A1 from the prior art, a method for cold gas spraying is described, in which a gas jet is generated by means of a cold gas spraying pistol, into which gas jet particles are introduced. The kinetic energy of the particles leads to the formation of a layer on a substrate that has a structured texture that is transferred to the forming layer.

According to this published document WO 2006/061384 A1, a high-temperature superconducting layer can be created on the substrate by means of a suitable composition of the particles. This process can additionally be supported by a heating apparatus in a following heat treatment step.

With respect to the technological background of the present invention, attention may additionally be drawn to the publication "Microstructural characteristics of cold-sprayed nanostructured WC-Co coatings" by R. S. Lima, J. Karthikeyan, C. M. Kay, J. Lindemann and C. C. Berndt, Preparation and Characterization, ELSEVIER Sequoia, N L, Thin Solid Films 2002, Volume 416, Nos. 1-2, pages 129 to 135, as well as to the published documents U.S. Pat. No. 5,646,094, US 2002/0056473 A1, US 2004/0026030 A1 and WO 2004/044672 A2 from the prior art.

SUMMARY OF THE INVENTION

Starting from the previously presented disadvantages and shortcomings and also according to an evaluation of the outlined prior art, the object of the present invention is to develop a method of the type mentioned at the beginning in such a manner that while eliminating the wire production, the coil winding and also the cast in procedure, a thoroughly compact coil without a degree of freedom of movement (elimination of the quench risk) can be produced.

A method for cold gas spraying wherein at least one substrate or at least one molding is coated by particles that are accelerated to the surface of the substrate or molding in the unmelted state by means of at least one gas jet and adhere thereunder the conversion of their kinetic energy, characterized in that the particles are selected from the group consisting of particles that are electrically conducting and particles that are electrically insulating.

A device for coating at least one substrate or for producing at least one molding by means of at least one cold gas spraying pistol, wherein the cold gas spraying pistol and the substrate or molding to be coated are arranged in a vacuum chamber, characterized in that the device is constructed to coat the substrate or molding with at least one conducting material and with at least one insulating material.

This object is achieved by a method with the features specified in claim 1 as well as by a device with the features specified in claim 8. Advantageous configurations and expedient developments of the present invention are characterized in the respective dependent claims.

The present invention is therefore based on a method for cold gas spraying (dynamic cold spraying), by means of which electrical conductors, particularly coils made from superconducting materials, can be produced. Using the cold gas spray method, a large selection of materials, that is to say electrical conductors (also superconductors) and dielectrics, can be deposited onto a substrate material or onto the substrate. As a result of the high speed of the sprayed particles, layers are formed, whose properties match those of cast or rolled materials.

Instead of producing a wire or winding a coil, in accordance with the method according to the invention the entire structure of a coil is now sprayed onto the coil substrate for example, that is to say a copper matrix, superconducting paths and insulation material. By means of corresponding shape and/or by means of corresponding guiding of the substrate material, coils can be produced in any desired shape and completely compactly as well as stably, for example in the shape of a stable block or in the shape of a compact block.

In a preferred development of the present invention, niobium-titanium (NbTi) or even niobium-tantalum is sprayed as a superconducting material together or alternately with copper as a material with high resistance, particularly as an insulation material, with the corresponding formation of a superconducting coil.

Particularly when using nanoparticles as the particles to be grown epitaxially onto the substrate or molding, a good intermixing of the particles integrated into the layer formed is guaranteed.

According to an expedient configuration of the present invention, the substrate or molding has a textured structure or structured texture that at least approximately corresponds to the textured structure or structured texture of a high-temperature superconductor (HTSC). This means in other words that the textured structure or structured texture of the substrate or molding can be transferred to the adhering particles.

The coating or layer formed from particles located in the cold gas jet therefore has a textured structure or structured texture that is determined by the texture of the substrate or molding on which the layer epitaxially grows.

Although as the layer buildup progresses the structured or textured substrate is no longer available for layer formation, the already applied particles have the desired textured structure or structured texture, so that these can also serve as a substrate for further impinging particles, that for their part obtain the desired textured structure or structured texture.

Insofar as the textured structure or structured texture of the substrate or molding is not yet completely transferred to the coating, this transfer can be completed by at least one diffusion process that can be started and/or supported by at least one heat treatment of the coated substrate or molding, which treatment can be provided in an expedient manner.

Thereby, the quality of the HTSC layer can advantageously be improved for example, wherefore in accordance with the device, at least one heating apparatus can be provided for carrying out a heat treatment of this type after the application of the particles. The superconducting properties, particularly the high-temperature superconducting properties, are thus regenerated by means of a targeted heat treatment after the spraying on.

In an advantageous configuration of the present invention, at least one reactive gas, particularly oxygen, can be added to the gas jet, which reactive gas is integrated into the layer. In this manner, the range of layers that can be generated can be increased in an expedient manner, since with the possibility of supplying at least one reactive gas comes a further optional parameter for influencing the method proceeding according to the present invention.

The present invention finally relates to the use of a method in accordance with the previously presented type and/or at least one device in accordance with the previously presented type for the production

- of, particularly superconducting, rotors and/or stators, particularly for electric motors, or
- of conducting, particularly superconducting, coils, particularly for M[agnetic]R[esonance]I[maging] devices or for N[uclear]M[agnetic]R[esonance] devices.

As a result, a simplified production as well as improved product properties of electrical conductors and coils, particularly of superconducting coils, for example of high-temperature superconducting coils, in comparison with the prior art are guaranteed with the method according to the present invention as well as with the device according to the present invention.

BRIEF DESCRIPTION OF THE DRAWINGS

As already discussed above, there exist various possibilities for configuring and developing the teaching of the present invention in an advantageous manner. To this end configurations, features and advantages of the present invention are explained in more detail below on the basis inter alia of the exemplary embodiment illustrated by the FIGURE.

The FIGURE shows, in a schematic representation, an exemplary embodiment of a device for cold gas spraying (dynamic cold spraying) according to the present invention, which device operates in accordance with the method according to the present invention.

DETAILED DESCRIPTION OF THE INVENTION

A device suitable for operating the method according to the invention and illustrated using the FIGURE has a vacuum chamber 4, in which a substrate 5 can be placed before the nozzle of a cold gas spraying pistol 3 (the placing of the substrate material or substrate 5 before the cold gas spraying pistol 3 takes place by means of a holder that is not shown in the FIGURE merely for reasons of clarity of the representation).

For carrying out the coating of the workpiece or the production of the molding 5, the vacuum chamber 4 is evacuated and a gas jet is generated by means of the cold gas spraying pistol 3, into which gas jet particles for coating the workpiece or for producing the molding 5 are fed.

Here, the main gas stream, for example a helium-nitrogen mixture with approximately forty vol % helium, makes it into the vacuum chamber 4 via the gas supply line 1. The spray particles in the auxiliary gas stream make it, via the supply line 2, into the vacuum chamber 4, in which a pressure of approximately forty millibars prevails, and there make it into the cold gas spraying pistol 3. The supply lines 1, 2 are, to this end, inserted into the vacuum chamber 4, in which both the cold gas spraying pistol 3 and also the molding 5 are located. The entire cold gas spraying process therefore takes place in the vacuum chamber 4.

The particles are accelerated so strongly by the cold gas jet that adherence of the particles on the surface of the substrate 5 to be coated is achieved by conversion of the kinetic energy of the particles. The particles can additionally be heated, whereby their heating is limited in such a manner that the melting temperature of the particles is not reached (this fact contributes to the term cold gas spraying by supplying its name).

The carrier gas that sprays out of the spraying gun 3 together with the spray particles during the cold gas spraying and carries the spray particles to the workpiece 5 makes it into the vacuum chamber 4 after the spraying process. The used carrier gas is removed from the vacuum chamber 4 via the gas line 6 by means of the vacuum pump 8. The particle filter 7 is connected between the vacuum chamber 4 and the vacuum pump 8, which particle filter removes the free spray particles from the used carrier gas in order to reliably prevent the solid particles from damaging the pump 8.

Using the cold gas spraying method illustrated using the FIGURE, a large selection of materials, that is to say electrical conductors, dielectrics and also superconductors can be applied to the substrate material 5. As a result of the high speed of the sprayed particles, layers are formed, whose properties match those of cast or rolled materials.

Instead of producing a wire or winding a coil, in accordance with the FIGURE, the entire structure of a coil can be sprayed onto the coil substrate 5, that is to say a copper matrix, superconducting paths and insulation material. By means of corresponding shape and guiding of the substrate material 5, coils can be produced in any desired shape and completely compactly as well as stably, for example in the shape of a stable block or in the shape of a compact block.

In the FIGURE, niobium-titanium (NbTi) or even niobium-tantalum is sprayed as a superconducting material together or alternately with copper as an insulation material (with relatively high resistance) with the formation of a superconducting coil.

The quality of this superconducting coil, particularly this high-temperature superconducting coil, can be increased by means of a heating apparatus (not shown in the FIGURE merely for reasons of clarity of the representation) for carrying out a heat treatment. The superconducting properties, particularly the high-temperature superconducting properties, are thus regenerated by means of a targeted heat treatment of this type after the spraying on.

The arrangement shown in the FIGURE is used according to the method in particular in the production of, for example superconducting, rotors and stators of electric motors as well as in particular in the production of coils for M[agnetic]R[esonance]I[maging] (MRI) devices or for N[uclear]M[agnetic]R[esonance] (NMR) devices.

REFERENCE LIST FOR THE FIGURE

1 Gas supply line
2 Supply line
3 Cold gas spraying pistol with nozzle
4 Vacuum chamber
5 Substrate or molding or substrate material
6 Gas line
7 Particle filter
8 Vacuum pump Having just described the invention, what I claim is:

1. A method for cold gas spraying wherein at least one substrate or at least one molding is coated by particles that are accelerated to the surface of the substrate or molding in the unmelted state by means of at least one gas jet and adhere thereunder through the conversion of their kinetic energy, characterized in that the particles are selected from the group consisting of particles that are electrically conducting and particles that are electrically insulating, and the electrically conducting particles and the electrically insulating particles are applied to the substrate or molding alternately or together wherein said electrically conducting particles are superconducting particles and wherein said electrically conducting property is provided by a material selected from the group consisting of niobium-titanium (NbTi) and niobium-tantalum and said electrically insulating property is provided by copper and at least one reactive gas is added to the gas jet wherein the reactive gas is integrated into the at least one substrate or at least one molding that is coated.

2. The method as claimed in claim 1 wherein said particles are applied to the substrate or molding forming at least one compact block or at least one stable structure.

3. The method as claimed in claim 1, characterized in that said electrically conducting particles contain the chemical constituents of at least one high-temperature superconductor selected from the group consisting of niobium-titanium (NbTi) and niobium-tantalum and said substrate or molding contain constituents of at least one high-temperature superconductor selected from the group consisting of niobium-titanium (NbTi) and niobium-tantalum and said substrate or molding has a textured structure or structured texture that corresponds to the textured structure or structured texture of a high-temperature superconductor.

4. The method as claimed in claim 1, characterized in that said particles are nanoparticles.

5. The method as claimed in claim 1, characterized in that said at least one reactive gas is oxygen.

6. The method as claimed in claim 1, characterized in that after the application of the particles, at least one heat treatment of the coated substrate or molding is carried out.

7. The method as claimed in claim 1, characterized that said method is for the production of rotors and stators, and of conducting coils.

* * * * *